US009901112B2

(12) United States Patent
Mei et al.

(10) Patent No.: US 9,901,112 B2
(45) Date of Patent: Feb. 27, 2018

(54) APPARATUS FOR PRODUCING RECONSTITUTED TOBACCO SHEET VIA DRY PAPER-MAKING METHOD

(71) Applicant: GUANGDONG GOLDEN LEAF TECHNOLOGY DEVELOPMENT CO., LTD., Shantou (CN)

(72) Inventors: Jianhua Mei, Shantou (CN); Dongliang Bai, Shantou (CN); Jianwei Song, Shantou (CN); Jiwu Ge, Shantou (CN); Long Wang, Shantou (CN); Jin Zhou, Shantou (CN); Tao Yang, Shantou (CN)

(73) Assignee: GUANGDONG GOLDEN LEAF TECHNOLOGY DEVELOPMENT CO., LTD., Shantou (CN)

( * ) Notice: Subject to any disclaimer, the term of this patent is extended or adjusted under 35 U.S.C. 154(b) by 123 days.

(21) Appl. No.: 14/892,897

(22) PCT Filed: Jan. 22, 2015

(86) PCT No.: PCT/CN2015/071307

§ 371 (c)(1),
(2) Date: Nov. 20, 2015

(87) PCT Pub. No.: WO2015/158175

PCT Pub. Date: Oct. 22, 2015

(65) Prior Publication Data

US 2016/0106143 A1 Apr. 21, 2016

(30) Foreign Application Priority Data

Apr. 17, 2014 (CN) ..... 2014 1 0155207

(51) Int. Cl.
*A24B 3/14* (2006.01)
*A24B 15/14* (2006.01)

(52) U.S. Cl.
CPC ..... *A24B 3/14* (2013.01); *A24B 15/14* (2013.01)

(58) Field of Classification Search
CPC ..... A24B 3/14; D21G 9/0018; D21F 3/10; D21F 1/08

(Continued)

(56) References Cited

U.S. PATENT DOCUMENTS

2002/0124977 A1* 9/2002 Brottgardh ..... D21C 9/02 162/56
2009/0071619 A1* 3/2009 Peltonen ..... D21F 1/06 162/232

FOREIGN PATENT DOCUMENTS

CN 102599633 A 7/2012
CN 103315376 A 9/2013

(Continued)

OTHER PUBLICATIONS

An Office Action issued by State Intellectual Property Office of the P.R. China dated Sep. 3, 2014 for Chinese application No. 201410155207.6.

(Continued)

*Primary Examiner* — Michael H. Wilson
*Assistant Examiner* — Russell E Sparks
(74) *Attorney, Agent, or Firm* — Michael B. Fein; Eckert Seamans Cherin & Mellott, LLC

(57) ABSTRACT

An apparatus that uses air-laid paper-making process to produce reconstituted tobacco is disclosed. The apparatus comprises a fiberizer, a base-sheet forming device, a pulp sizing device and a drying device connected in series. The apparatus of the invention is equipped with different interfaces for various materials and an internal humidifying pipeline. Utilizing multiple passages for material transfer helps to improve uniformity of incoming material and (Continued)

controllability. The sized pulp contains more tobacco dusts, tobacco extract, and adhesive agent, which has a higher density. By utilizing this apparatus it can disperse the pulp fully to avoid hot air being unevenly distributed in drying oven from causing excessive drying issue.

12 Claims, 9 Drawing Sheets

(58) Field of Classification Search
USPC ..... 131/374, 372, 302; 162/55
See application file for complete search history.

(56) References Cited

FOREIGN PATENT DOCUMENTS

| | | | | | |
|---|---|---|---|---|---|
| CN | 103431514 | A | * | 12/2013 | ..... A24B 3/14 |
| CN | 103892440 | A | | 7/2014 | |
| CN | 203776146 | U | | 8/2014 | |
| GB | 2159036 | A | | 11/1985 | |

OTHER PUBLICATIONS

An Office Action issued by State Intellectual Property Office of the P.R. China dated Dec. 31, 2014 for Chinese application No. 201410155207.6.
International Search Report issued by the State Intellectual Property Office of the P.R. China dated Apr. 16, 2015 for the International Patent Application No. PCT/CN2015/071307.

* cited by examiner

APPARATUS FOR PRODUCING RECONSTITUTED TOBACCO SHEET VIA DRY PAPER-MAKING METHOD

CROSS-REFERENCE TO RELATED APPLICATIONS

This application is the U.S. national stage of PCT/CN2015/071307 filed Jan. 22, 2015, which claims priority from Chinese application 201410155207.6 filed Apr. 17, 2014, both of which are hereby incorporated by reference.

FIELD OF THE INVENTION

This invention relates to an apparatus for producing tobacco products, more particularly, to a production line using an air-laid paper-making process to produce reconstituted tobacco leaves (TRL) and equipment used therefor.

BACKGROUND OF THE INVENTION

Reconstituted tobacco leaf, that is, tobacco sheet, also known as reconstituted tobacco or homogenized tobacco, is produced mainly from tobacco dust, stems, low-grade tobacco leaves, and additional foreign fibers, adhesives or other additives. As a kind of material widely used in tobacco product, reconstituted tobacco has the advantages of low cost, good filling performance, less tar content in the smoke, and so on. The production of reconstituted tobacco began in the '50s of the 20th century. Its production processes mainly include slurry process, rolling process and paper-making process, and the paper-making process is further divided into wet paper-making process and air-laid paper-making process. However, being it wet paper-making process or air-laid paper-making process, plant fiber pulp boards have to be fiberized for further formation. The wet paper-making process uses a first-level refiner and a second-level refiner to moderately grind fibers to make them become individualized after using a hydrapulper to crush the pulp boards. These fibers will then become pulp after being beat and fibrillated in the water. The pulp will then be put in a pulp tank for use after it is processed by a high-density sand remover and a tickler. As for the air-laid paper-making process, it fiberizes the fibers in the air without water. Usually, it uses high-speed rotating needle dials, hammers, claw disks or second-level crushing devices to fiberize the fibers to make them individualized.

After 20 years of research and use, this technology is quite well developed and has been widely used tobacco products. However, it still has some problems. Firstly, after the processes of extracting, concentrating and refining, scent and aroma of the tobacco are significantly reduced. Secondly, the reconstituted tobacco produced by this process is structurally solid and slick on the surface. Therefore, it has lower weight gain (normally less than 40%) and lacks taste. Thirdly, it produces large amounts of wastewater. In order to overcome the disadvantages of traditional wet paper-making processes, and to reduce environmental pollution and harmful components in China, a new process and equipment in this field for improving the quality of reconstituted tobacco and reducing environment pollution has to be developed.

A new kind of equipment using air-laid paper-making process to produce reconstituted tobacco can not only protect the environment by reducing the large amount of sewage discharge generated during the production but also prevent aroma loss in reconstituted tobacco. Its weight gain on the base sheets can be increased to more than 200%, and both filling power and wet strength has improved. Compared with traditional paper-making process, it can also reduce more harmful aspects in the smoke.

The air-laid paper-making process was born in the '60s of the 20th century and introduced into China at the end of the '80s of the 20th century. After 20 years of development, the air-laid paper-making process has become fully mature and well-known. For example, Chinese Patent Application No. 200610117771.4 discloses a paper-making machine that uses aid-laid process. Moreover, a Chinese patent No. 201310393610.8 discloses a complete production line that uses air-laid process to produce reconstituted tobacco. Other than having two more adhesive and drying devices, the machine has no different from ordinary air-laid paper-making machine in terms of manufacturing techniques. It does not have special devices, especially fiberizing, forming, sizing and drying devices, necessary for producing reconstituted tobacco. Even the most well-known wet paper-making machine cannot be used directly to produce reconstituted tobacco, instead, corresponding devices required by the nature of reconstituted tobacco has to be designed for production of the same. Similarly, an ordinary air-laid paper-making machine cannot be used directly to produce reconstituted tobacco either; instead, corresponding devices required by the nature of reconstituted tobacco has to be designed or added for production of the same.

SUMMARY OF THE INVENTION

In order to overcome the above disadvantages, this invention provides a production line and equipment therefor that can overcome drawbacks in both the wet paper-making and air-laid paper-making processes for producing reconstituted tobacco.

This invention provides an apparatus that uses air-laid paper-making process to produce reconstituted tobacco, comprising a fiberizer, a base-sheet forming device, a pulp sizing device and a drying device connected in series, wherein the fiberizer comprises a rough crusher 101, a fine crusher 102, a fiber storage tank 103 and a fiber calculator 104 connected in series, a material inlet is arranged at a front end of the rough crusher 101, and a material outlet of the fiber calculator 104 is connected to the base-sheet forming device of the apparatus, the fiberizer further comprises an anti-static humidifying device, the anti-static humidifying device comprises a high-moisture air generator 105 and high-moisture air pipelines, an output of the high-moisture air generator 105 is connected to the material inlet of the rough crusher 101 and the material outlet of the fiber calculator 104 via the high-moisture air pipelines respectively.

The base-sheet forming device comprises forming mesh belts, a mesh belt conveying device, a base-sheet forming device rack 218 arranged above the forming mesh belts, one or more sets of forming heads are arranged inside the base-sheet forming device rack 218, a blow-off device is provided in the forming head, a negative pressure device is arranged underneath the forming mesh belts, a first screen cylinder 213 and a second screen cylinder 214 are arranged symmetrically to each other in each set of forming head, a first fiber conveying pipeline 201 and a second fiber conveying pipeline 202 are arranged along an axial direction of the first screen cylinder 213, a third fiber conveying pipeline 203 and a fourth fiber conveying pipeline 204 are arranged along an axial direction of the second screen cylinder 214, the first fiber conveying pipeline 201 and the second fiber conveying pipeline 202 are arranged symmetrically in an upper part of the first screen cylinder 213, the third fiber conveying pipeline 203 and the fourth fiber conveying pipeline 204 are arranged symmetrically in an upper part of the second screen cylinder 214, a first breaking roller 212 and a second breaking roller 211 are arranged in a lower part of the first screen cylinder 213 and a lower part of the second screen cylinder 214 respectively, the first breaking roller 212 and the second breaking roller 211 are located exactly under center points of the first screen cylinder 213 and the second screen cylinder 214 respectively, a front circular passage 215 and a rear circular passage 216 communicating internal spaces of the first screen cylinder 213 and the second screen cylinder 214 are arranged at front sides and rear sides thereof respectively.

The pulp sizing device comprises a constant pressurized storage tank 305 and a pulp distributor 322 connected to a material outlet of the constant pressurized storage tank 305, the pulp distributor 322 has multiple pulp outlets 324, each being connected to a pulp buffer 314 via a proportioning pump 325, the pulp buffer 314 is connected to a pulp inlet 329 of a dual spray nozzle 328 via a check valve 319, the dual spray nozzle 328 is further equipped with a compressed air inlet 330, a compressed air regulating valve 331 is connected to the compressed air inlet 330 through a pipeline, the pulp sizing device further comprises a sizing device rack 304 arranged on the mesh belt, installation boxes 301 are arranged on both sides of the sizing device rack 304, the pulp distributor 322 and the proportioning pump 325 are installed inside the installation boxes 301, the pulp buffer 314 is installed on a pulp buffer supporting rack 334 located in the middle of the sizing device rack 304, a nozzle supporting rack 332 is arranged in the middle of the sizing device rack 304, a plurality of nozzle supporting racks 333 with adjustable lengths and angles are arranged on the nozzle supporting rack 332, dual spray nozzles 328 are installed on the nozzle supporting racks 333.

The drying device comprises a drying device body and a hot-air inlet 411 connected to the drying device body, wherein three fixed dampers of a first damper 401, a second damper 402 and a third damper 403 are arranged in the drying device body, the three fixed dampers are arranged parallel to each other and distances between two neighboring dampers are equal to each other, the three fixed dampers are arranged in the drying device body and connected to the hot-air inlet 411, an adjustable baffle is arranged at a tail end of each damper, and a moisture-discharging device 407 is arranged at a rear end of the drying device body.

In the invention, the rough crusher 101 of the fiberizer further has an independent material inlet arranged at the front end thereof, the material inlet comprises a fiber material inlet 112 and a particulate material inlet 113, with independent switches arranged on the fiber material inlet 112 and the particulate material inlet 113 respectively.

Preferably, a movable and detachable multi-passage retainer is arranged at the material inlet of the rough crusher 101 of the fiberizer.

More preferably, the first screen cylinder 213 and the second screen cylinder 214 of the base-sheet forming device are of opposite rotating directions.

According to another preferable implementation of the invention, each screen cylinder of the base-sheet forming device and a breaking roller arranged in the screen cylinder are of opposite rotating directions.

In this invention, the first fiber conveying pipeline 201 and the fourth fiber conveying pipeline 204 of the base-sheet forming device are of a same length, the second fiber conveying pipeline 202 and the third fiber conveying pipeline 203 are of a same length, the first fiber conveying pipeline 201 is longer than the second fiber conveying pipeline 202, the first fiber conveying pipeline 201 and the second fiber conveying pipeline 202 extend from a front part of the first screen cylinder 213 toward the interior of the first screen cylinder 213, and the third fiber conveying pipeline 203 and the fourth fiber conveying pipeline 204 extend from a rear part of the first screen cylinder 213 toward the interior of the first screen cylinder.

Preferably, the pulp buffer supporting rack 334 of the pulp sizing device is of a ∪ shape.

More preferably, the constant pressurized storage tank 305 of the pulp sizing device comprises a tank body, a pulp outlet 313 arranged at a bottom of the tank body, a pulp inlet 312 arranged on a side at an upper part of the tank body and an agitator 306 arranged inside the tank body, the constant pressurized storage tank 305 is further equipped with a pressure indicator 307, an overpressure relief valve 308 arranged on an upper part of the tank body, a constant pressure controller 309 and a compressed air regulating valve 310, an agitator motor 311 connected to the agitator 306 is further arranged on the upper part of the tank body.

In this invention, the pulp buffer 314 of the pulp sizing device has a buffer pulp inlet 317 and a buffer pulp outlet 318, the pulp buffer inlet 317 is arranged on a side at a lower-middle part of the pulp buffer 314, the pulp buffer outlet 318 is arranged at a bottom of the pulp buffer 314, an exhaust valve 315 and a pressure indicator 316 are further arranged at an upper part of the pulp buffer.

In this invention, the adjustable baffles and the dampers of the drying device are connected through movable pins, and angles between the adjustable baffles and the dampers are adjustable.

Preferably, the forced moisture-discharging device 407 of the drying device comprises a negative pressure box 409 and moisture deflectors 408 arranged inside the negative pressure box 409, the negative pressure box 409 is communicated to the body of the drying device, and connected to a negative-pressure blower 410 via a pipeline, and the negative-pressure blower 410 is connected to a controller of a frequency converter.

More preferably, lengths of the first damper 401, the second damper 402 and the third damper 403 of the drying device have equal differences between one and another, and partition the drying box into four sections.

Technical solutions of the invention will be described in more detail in the following.

The apparatus that uses air-laid paper-making process to produce reconstituted tobacco comprises a fiberizer, a base-sheet forming device, a pulp sizing device and a drying device connected in series. The first process for using the air-laid paper-making process to produce reconstituted tobacco is to fiberize plant fiber pulp boards. However, conventional production lines using air-laid paper-making process have advantages. On one hand, in order to make the tobacco taste good, two or more plant fibers are needed to be added through a metering device in the process of fibrillation to make them into multi-fiber base sheets. On the other hand, due to the nature of reconstituted tobacco produced by the air-laid paper-making machine, it is necessary to reduce the amount of foreign fibers on base sheets. To do so, when being fiberized, fiber-shaped or granule-shaped tobacco materials need to be added to be fiberized together with plant fibers simultaneously, such that reconstituted tobacco base-sheets with less foreign fibers are produced. However, the conventional fiberizer used for air-laid paper-making process can only fiberize a single kind of fiber. Other than that, static electricity is another problem. In the air-laid paper-making process, the process of fiberizing needs to be run in the air, during which static electricity will be formed when fibers are span and rubbed at high speed in the air. When there is too much static electricity accumulated on the surface of the fibers, these fibers will get together as to affect the dispersal, transmission and formation of the fibers. Usually, this phenomenon can become more serious under an ambient humidity of lower than 50%, resulting in production shutdown.

Therefore, in the apparatus of the invention, the fiberizer comprises a rough crusher 101, a fine crusher 102, a fiber storage tank 103 and a fiber calculator 104 connected in series. A material inlet is arranged at a front end of the rough crusher 101, and a material outlet of the fiber calculator 104 is connected to the base-sheet forming device of the apparatus. The fiberizer further comprises an anti-static humidifying device, the anti-static humidifying device comprises a high-moisture air generator 105 and high-moisture air pipelines, an output of the high-moisture air generator 105 is connected to the material inlet of the rough crusher 101 and the material outlet of the fiber calculator 104 via the high-moisture air pipelines respectively.

The rough crusher 101 of the fiberizer further has an independent material inlet arranged at the front end thereof, the material inlet comprises a fiber material inlet 112 and a particulate material inlet 113, with independent switches arranged on the fiber material inlet 112 and the particulate material inlet 113 respectively.

Preferably, the rough crusher 101 may have two or more sets of material inlets.

By arranging two or more sets of material inlets on sides of the rough crusher, additionally introduced fiber-shaped or granule-shaped materials can be added to the rough crusher through these inlets. These extra added materials, together with the mixed plant fiber pulp boards coming from the material inlet, will be crushed into 1-2 $cm^2$ chips by rolling knives of the rough crusher. After being fiberized by fluted discs of the fine crusher, these chips, mixed with fiber-shaped or granule-shaped materials, will be put into a storage tank, whose agitators will mix these materials together. Finally, these mixed materials will be delivered to the fiber forming device by the fiber calculator. The above-inlets are controlled by a frequency converter, which establishes relevant modules for speed and quantity of the material inlet to make the formulation of different kinds of fibers in line with the one required by techniques in producing reconstituted tobacco base-sheets with the air laid process.

Preferably, a movable and detachable multi-passage retainer is arranged at the material inlet of the rough crusher 101 of the fiberizer.

Through arranging the movable and multi-passage retainer at the material inlets of the rough crusher, different kinds of plant fiber pulp boards can be conveniently fed to the rough crusher to be fiberized through separate passages, which is very convenient. When a single kind of fiber needs to be fiberized, the retainer can be removed.

In this invention, the high-moisture air generator may be a high-pressure nozzle or an ultrasonic atomizer. Preferably, a high-moisture air generator with a capacity of 1 $m^3$ is arranged on an operating side of the fiberizer, so as to provide sufficient atomizing moist air with a humidity of over 80% with the high-pressure nozzles or ultrasonic atomizer. A closed loop is formed by an $\phi$ 16 mm PE pipe arranged at the outlet of the high-moisture air generator and connecting a blower at the material inlet of the rough crusher and a blower at the fiber calculator 104. Under the influence of negative pressure of the fiberizing system, the wet air will constantly be sucked in to moisten an internal delivery system for plant fiber pulp boards.

By using the paper-making process, also known as wet paper-making process, to produce reconstituted tobacco, firstly, lower-grade tobacco materials are extracted with water; secondly, after insoluble matters and added natural fibers are made into fibers, these fibers will go into the paper-making machine to be made into sheets. Thirdly, after being dried, this paper will be soaked in concentrated extraction liquid and additive agent. Finally, after being dried, the paper will be the finished product. Reconstituted tobacco produced by such paper-making process has certain strength, better filling power and less tar content when being used in cigarette, but it has disadvantages, such as creating large amounts of sewage discharge when producing it, requiring a lot of equipment investment having higher running costs.

Base-sheet formation is the second step in using the air-laid paper-making process to produce reconstituted tobacco, with a principle as follows: after being fiberized, natural fibers will be dispersed in the air. Then, the fibers will be pneumatically sent to the forming device. Each forming head is equipped with two screen cylinders that have small openings all over their bodies. The two screen cylinders are laid horizontally on the forming belt and of opposite rotating directions. Pipelines for delivering the fibers and nail rollers for beating fibers are arranged in the screen cylinder. The nail rollers and the screen cylinder are rotating in opposite directions so that the fibers delivered by wind can be beaten. The fibers, after being beaten, drop down from the screen cylinder and fall on the forming belt. A vacuum chamber forming negative pressure is arranged beneath the forming belt. Under the protection from negative pressure, a fibrous layer is formed and the forming belt moves forward, forming a consecutive and an even fibrous layer, namely, the base sheet of the reconstituted tobacco produced by the air-laid paper-making process. And then, the next manufacturing process follows.

The base-sheet forming device of the invention comprises forming mesh belts, a mesh belt conveying device, a base-sheet forming device rack 218 arranged above the forming mesh belts, one or more sets of forming heads are arranged inside the base-sheet forming device rack 218, a blow-off device is provided in the forming heads, a negative pressure device is arranged underneath the forming mesh belts, a first screen cylinder 213 and a second screen cylinder 214 are arranged symmetrically to each other in each set of forming heads, a first fiber conveying pipeline 201 and a second fiber conveying pipeline 202 are arranged along an axial direction of the first screen cylinder 213, a third fiber conveying pipeline 203 and a fourth fiber conveying pipeline 204 are arranged along an axial direction of the second screen cylinder 214, the first fiber conveying pipeline 201 and the second fiber conveying pipeline 202 are arranged symmetrically in an upper part of the first screen cylinder 213, the third fiber conveying pipeline 203 and the fourth fiber conveying pipeline 204 are arranged symmetrically in an upper part of the second screen cylinder 214, a first breaking roller 212 and a second breaking roller 211 are arranged in a lower part of the first screen cylinder 213 and a lower part of the second screen cylinder 214 respectively, the first breaking roller 212 and the second breaking roller 211 are located exactly under center points of the first screen cylinder 213 and the second screen cylinder 214 respectively, a front circular passage 215 and a rear circular passage 216 communicating internal spaces of the first screen cylinder 213 and the second screen cylinder 214 are arranged at front sides and rear sides thereof respectively.

Preferably, the first screen cylinder 213 and the second screen cylinder 214 are of opposite rotating directions, each set of screen cylinders and the breaking roller arranged therein are of opposite rotating directions.

More preferably, the first fiber conveying pipeline 201 and the fourth fiber conveying pipeline 204 of the base-sheet forming device are of a same length, the second fiber conveying pipeline 202 and the third fiber conveying pipeline 203 are of a same length, the first fiber conveying pipeline 201 is longer than the second fiber conveying pipeline 202.

Especially preferably, the first fiber conveying pipeline 201 and the fourth fiber conveying pipeline 204 are 50-60 cm, and the second fiber conveying pipeline 202 and the third fiber conveying pipeline 203 are 30-40 cm.

More preferably, the first fiber conveying pipeline 201 and the second fiber conveying pipeline 202 extend from a front part of the first screen cylinder 213 toward the interior of the first screen cylinder 213, and the third fiber conveying pipeline 203 and the fourth fiber conveying pipeline 204 extend from a rear part of the first screen cylinder 213 toward the interior of the first screen cylinder.

In this invention, two or more delivery pipelines may be arranged in the screen cylinder of the base-sheet forming device.

For the purpose of further improving the uniformity of fiber distribution, more openings may be made on the fiber delivery pipelines.

In this invention, by arranging two fiber conveying pipelines with different lengths inside each screen cylinder, the fibers will have more exits, thereby improving the accuracy of the delivery of fibers.

A front and rear circular passages communicating internal space of one forming head are arranged between two screen cylinders in the forming head, reducing accumulation of fibers at both ends of the screen cylinders.

After going through the base-sheet forming device, paper webs are formed after the fibrous layer is pre-pressed, which is the so-called reconstituted tobacco base sheets. The base sheets are laid on the belt. The sizing device sizes sizing agents on the base sheets. Negative pressure on the reverse side of the base sheets helps to protect base sheets from tilting and pulp from spilling when sizing, such that the sizing agents can easily penetrate the base sheets. A quantity for the sizing agents on the base sheets can be adjusted as required. After being sized with sizing agents, the base sheets go into the drying box to be dried under a drying temperature of 105° C.-110° C. After the drying, one side of the base sheet has sizing agents on its surface. Then the base sheets is transferred to lower side of the sizing drying mesh through the belt, where the other side will be sized with sizing agents. Negative pressure protection is also present on the other side, preventing the base sheets from tilting and the pulp from spilling, which also facilitates the penetration of the sizing agents to the base sheets. The quantity for the sizing agents on the base sheets can be adjusted as required. After being sized with sizing agents, the base sheets go into the drying box to be dried under a drying temperature of 105° C.-110° C. After drying, the base sheets is transferred to the upper side of the sizing drying mesh through the belt where, once again, the first side will be sized with sizing agents. There is negative pressure protecting the reverse side of the sizing side to prevent base sheets from tilting and pulp from spilling. After four times of sizing and drying, the base sheet becomes reconstituted tobacco which, through the delivery mesh, is transported to the cutting machine, where the reconstituted tobacco is cut into pieces of a certain size, becoming the finished product.

The pulp sizing device of the invention comprises a constant pressurized storage tank 305 and a pulp distributor 322 connected to a material outlet of the constant pressurized storage tank 305, the pulp distributor 322 has multiple pulp outlets 324, each being connected to a pulp buffer 314 via a proportioning pump 325, the pulp buffer 314 is connected to a pulp inlet 329 of a dual spray nozzle 328 via a check valve 319, the dual spray nozzle 328 is further equipped with a compressed air inlet 330, a compressed air regulating valve 331 is connected to the compressed air inlet 330 through a pipeline.

The pulp sizing device further comprises a sizing device rack 304 arranged on the mesh belt, installation boxes 301 are arranged on both sides of the sizing device rack 304, the pulp distributor 322 and the proportioning pump 325 are installed inside the installation boxes 301, the pulp buffer 314 is installed on a pulp buffer supporting rack 334 located in the middle of the sizing device rack 304, a nozzle supporting rack 332 is arranged in the middle of the sizing device rack 304, a plurality of nozzle supporting racks 333 with adjustable lengths and angles are arranged on the nozzle supporting rack 332, dual spray nozzles 328 are installed on the nozzle supporting racks 333.

Preferably, the pulp buffer supporting rack 334 of the pulp sizing device is of a ∪ shape.

The constant pressurized storage tank 305 comprises a tank body, a pulp outlet 313 arranged at a bottom of the tank body, a pulp inlet 312 arranged on a side at an upper part of the tank body and an agitator 306 arranged inside the tank body, the constant pressurized storage tank 305 is further equipped with a pressure indicator 307, an overpressure relief valve 308 arranged on an upper part of the tank body, a constant pressure controller 309 and a compressed air regulating valve 310, an agitator motor 311 connected to the agitator 306 is further arranged on the upper part of the tank body.

More preferably, the pulp buffer 314 of the pulp sizing device has a buffer pulp inlet 317 and a buffer pulp outlet 318, the pulp buffer inlet 317 is arranged on a side at a lower-middle part of the pulp buffer 314, the pulp buffer outlet 318 is arranged at a bottom of the pulp buffer 314, an exhaust valve 315 and a pressure indicator 316 are further arranged at an upper part of the pulp buffer.

In this invention, the proportioning pump 325 may be screw proportioning pump, a peristaltic proportioning pump or a diaphragm proportioning pump. A single proportioning pump of each of the above or combinations thereof may be used.

In this invention, the pulp distributor 322 has four to eight pulp outlets 324 of. Through the pulp distributor, a constant pressurized storage tank may be connected to multiple sets of sizing devices to realize stable and synchronized sizing.

Preferably, two sets of nozzle supporting racks 332 are arranged symmetrically from each other in the installation box. Each nozzle supporting rack 332 has 4 to 10 nozzle supporting racks 333 arranged on an external side.

In this invention, the check valve 319 may be an angle seat valve, an electric check valve or a pneumatic check valve. A single check valve of each of the above or combinations thereof may be used.

Preferably, an adhesive receiving device 303 is arranged beneath the installation box 301. The adhesive receiving device 303 comprises an adhesive receiving tank and an adhesive receiving fence arranged on the adhesive receiving tank. An adhesive scraping device comprises a drive motor, an adhesive scraping roller connected to the drive motor, and an adhesive wiping board arranged on one end of the adhesive scraping roller.

The drying device comprises a drying device body and a hot-air inlet 411 connected to the drying device body, wherein three fixed dampers of a first damper 401, a second damper 402 and a third damper 403 are arranged in the drying device body, the three fixed dampers are arranged parallel to each other and distances between two neighboring dampers are equal to each other, the three fixed dampers are arranged in the drying device body and connected to the hot-air inlet 411, an adjustable baffle is arranged at a tail end of each damper, and a moisture-discharging device 407 is arranged at a rear end of the drying device body.

The adjustable baffles and the dampers of the drying device are connected through movable pins, and angles between the adjustable baffles and the dampers are adjustable. Preferably the angle is between 60° to 150°.

In this invention, there may be three or more pieces of dampers.

Preferably, in this invention, two sets of identical drying devices are connected via the forced moisture-discharging device.

The forced moisture-discharging device 407 comprises a negative pressure box 409 and moisture deflectors 408 arranged inside the negative pressure box 409, the negative pressure box 409 is communicated to the body of the drying device, and connected to a negative-pressure blower 410 via a pipeline, and the negative-pressure blower 410 is connected to a controller of a frequency converter.

Preferably, lengths of the first damper 401, the second damper 402 and the third damper 403 of the drying device have equal differences between one and another. The three adjustable baffles are of different lengths, and differences between two neighbouring adjustable baffles are equal to each other and the drying box is partitioned into four sections.

More preferably, the distance between the three dampers is 8-15 cm.

Three or more fixed dampers with equal difference in length and connected to respective adjustable dampers with movable pins are arranged inside the oven. The angle between fixed dampers and adjustable dampers can be adjusted based on actual needs during operation.

Forced moisture discharging device is arranged between every two sets of ovens. The forced moisture discharging device comprises a deflector, a negative pressure box, which is connected to a negative pressure blower. The negative-pressure blower controlled by a frequency converter, forming a low temperature, fast drying system through drying, moisture discharging, second drying, and second moisture discharging.

Compared with conventional technologies, this invention has the following advantageous effects.

First of all, the fiberizer is equipped with different interfaces for various materials and an internal humidifying pipeline, such a configuration helps to, in the first place, overcome defect of utilizing a single fiber as raw material of the conventional technologies, and multi-fiber and additives help to improve the taste of reconstituted tobacco leaves. In the second place, it helps to reduce static electricity generated in the process of fiberizing, eliminating the need of adding antistatic agent, preventing the negative influence of antistatic agent on the taste of reconstituted tobacco leaves.

In comparison with low basis weight of forming device and conventional technologies, this invention has the following advantages: A. It overcomes problem of utilizing a single feed pipe by the conventional technology; instead, multiple pipes are used to improve uniformity and controllability of feed material. B. Circular passages can prevent fiber accumulating in the box, making formed reconstituted tobacco leave base sheet of good uniformity. C. Weight of traditional dry sheet is around 40 g/m$^2$, and grams below 40 g/m$^2$ is difficult to achieve. According to the invention, a better controllability is achieved as a result of accurate measure of the fiber during transportation, moreover, uniform distribution of the fiber is realized during transportation, together with uniform blowing air, good controllability of negative pressure box, and uniform adjustability of negative pressure, basis weight of less than 20 g/m$^2$ for base sheet can be achieved.

In comparison with the conventional technologies, the sizing device with high viscosity and high solid content of this invention has the following advantages. A. In conventional technologies, a solid content of the sized adhesive is around 6%, while the pulp of this sizing device has a solid content of above 15%, making it of poor mobility. By utilizing this sizing device, pulp with high solid content can be evenly distributed to reach an accurate measure. B. It overcomes the defect that only sizing material of lower viscosity can be applied in the conventional sizing device for air-laid paper-making process technology. Sizing material for the present device contains more tobacco dusts, tobacco extract, and adhesive agent, which can be evenly distributed by using the present apparatus. C. The present sizing device also overcomes the problem that only weight gain of up to 40% can be achieved by utilizing the conventional device, while weight gain for the current device can reach above 80%, with 200% weight gain to the base sheet (In this invention, weight gain is interpreted as increased weight of the base sheet after the base sheet is sized, dried. Ratio between additional weight to the original base sheet is weight gain. This index is a calculation for tobacco component contained in RTL, which is also an important index for RTL).

In comparison with the conventional technologies, forced moisture elimination drying device at low temperature has the following 2 advantages. A. Moisture content after drying of the conventional dried sheet is low, allowing a drying oven of low drying efficiency to achieve a good drying effect. With the present invention, moisture content in the final sheet is above 7 times that of the base sheet. To prevent tobacco components loss during drying process, temperature of drying oven cannot be increased without limitation. This invention adopts forced moisture elimination device which is installed between 2 sections of drying ovens to speed up air circulation to remove moisture in RTL. B. In the drying device a deflector is introduced, which is different from the conventional drying oven without flow guide device leading to over drying caused by uneven distribution of inside hot air. The drying device of the present invention is equipped with the deflector, which can be adjusted as needed to ensure the whole sheet is dried synchronously, and to avoid tobacco aroma loss caused by partially overheated and generating burnt taste.

NUMERAL REFERENCES

101 rough crusher, 102 fine crusher, 103 fiber storage tank, 104 fiber calculator, 105 high humidity air generator, 106 air inlet of rough crusher, 107 air inlet of fiber calculator, 108 movable retainer, 109 feeding channel separated by movable retainer, 112 fiber material inlet, 113 particulate material inlet, 114 material inlet of rough crusher

201 first fiber conveying pipeline, 202 second fiber conveying pipeline, 203 third fiber conveying pipeline, 204 fourth fiber conveying pipeline, 205 fifth fiber conveying pipeline, 206 sixth fiber conveying pipeline, 207 seventh fiber conveying pipeline, 208 eight fiber conveying pipeline, 209 ninth fiber conveying pipeline, 210 tenth fiber conveying pipeline, 211 first breaking roller, 212 second breaking roller, 213 first screen cylinder, 214 second screen cylinder, 215 front circular passage, 216 rear circular passage, 217 negative pressure box, 218 base sheet forming device rack, 219 mesh belt

301 installation box, 302 negative pressure box for sizing device, 303 adhesive receiving device, 304 sizing device rack, 305 constant pressure storage tank, 306 agitator, 307 pressure indicator, 308 overpressure safety valve, 309 constant pressure controller, 310 compressed air regulating valve, 311 agitator motor, 312 pulp inlet, 313 pulp outlet, 314 pulp buffer, 315 pressure relieve valve, 316 pressure indicator, 317 pulp inlet, 318 pulp outlet, 319 check valve, 320 pulp inlet, 321 pulp outlet, 322 pulp distributor, 323 pulp inlet, 324 pulp outlet, 325 proportioning pump, 326 pulp inlet, 327 pulp outlet, 328 dual spray nozzle, 329 pulp inlet, 330 compressed air inlet, 331 compressed air regulating valve, 332 main nozzle supporting rack, 333 movable nozzle supporting rack 334 pulp buffer supporting rack, 335 adhesive receiving fence, 336 rotating shaft, 337 adhesive scraper, 338 rotary motor

401 first damper, 402 second damper, 403 third damper, 404 first adjustable baffle, 405 second adjustable baffle, 406 third adjustable baffle, 407 forced moisture discharging device, 408 deflector, 409 negative pressure box, 410 negative pressure blower, 411 hot air inlet

Detail Description of the Embodiments

The invention will be described more detail in the following in connection with detailed embodiments. The embodiments are for illustrative purpose only and do not intend to limit the technical scope of the invention, which is defined by the appended claims.

Figure 1:
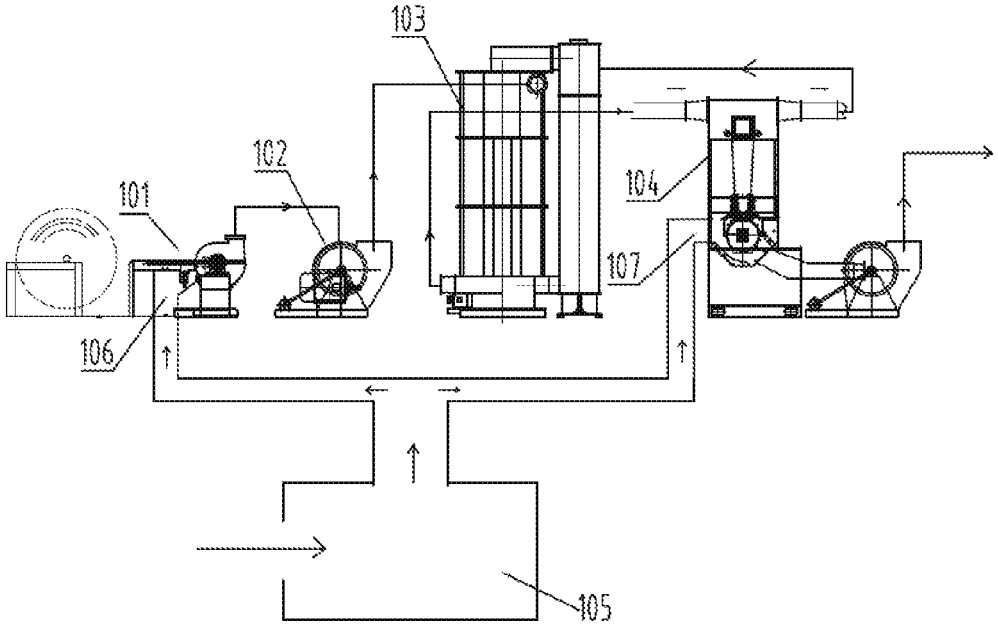
FIG. 1 is a front view of a fiberizer and a count and converging system
Figure 2:
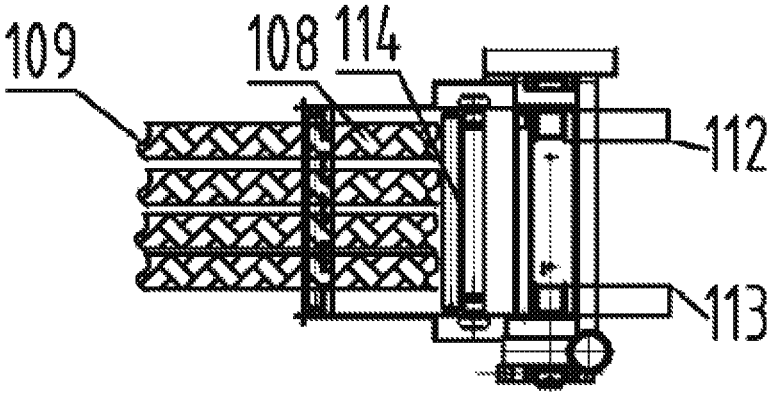
FIG. 2 is a top view of a rough crusher.
Figure 3:
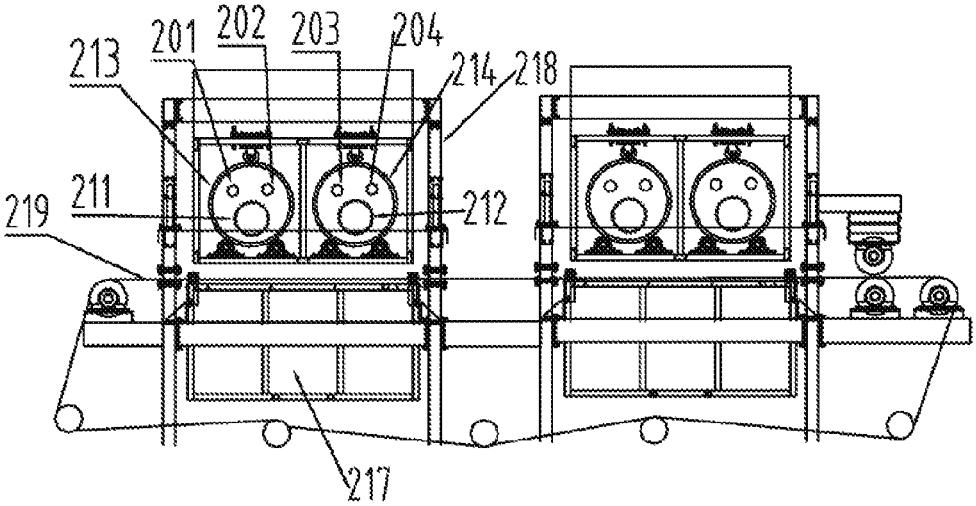
FIG. 3 schematically illustrates a base sheet forming device.
Figure 4:
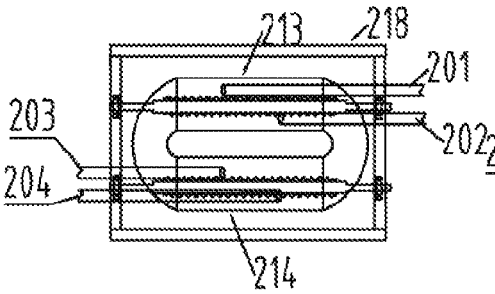
FIG. 4 schematically illustrates an arrangement of two fiber conveying pipelines in a forming head.
Figure 5:
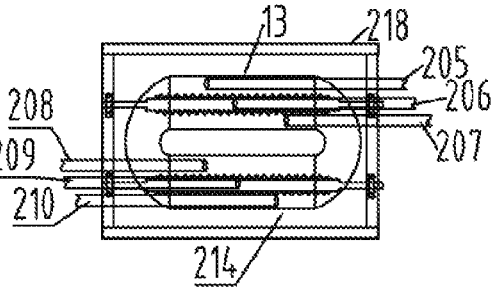
FIG. 5 schematically illustrates an arrangement of three fiber conveying pipelines in a forming head.
Figure 6:
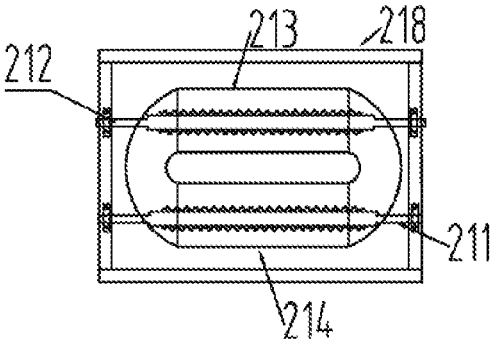
FIG. 6 schematically illustrates a breaking roller in a forming head.
Figure 7:
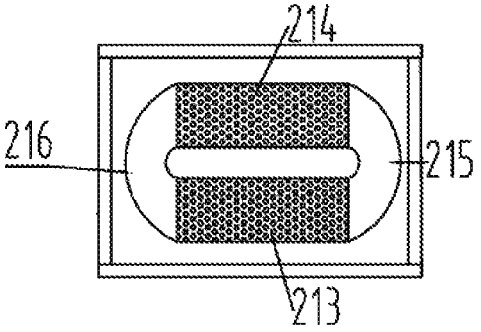
FIG. 7 schematically illustrates a screen cylinder and circular passages in a forming head.
Figure 8:
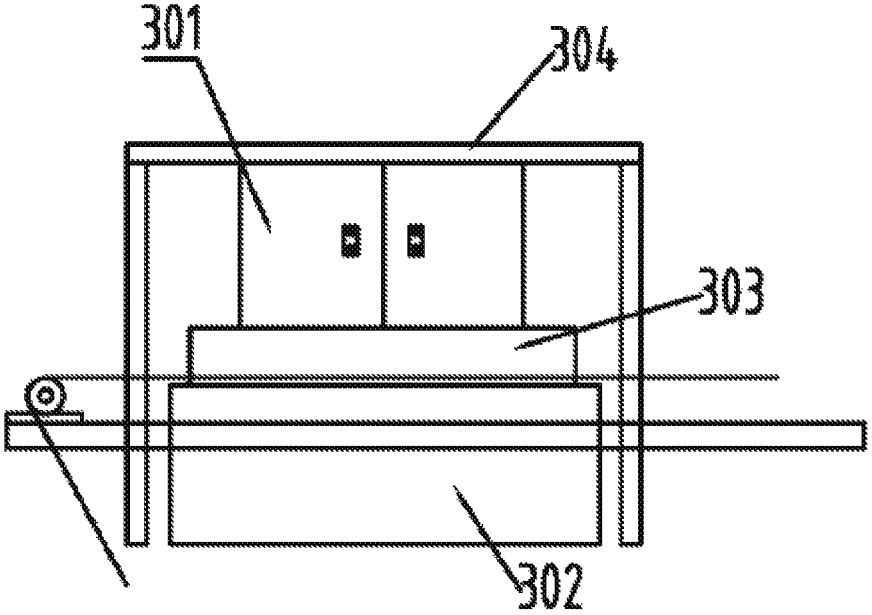
FIG. 8 schematically illustrates a pulp sizing device of the invention.
Figure 9:
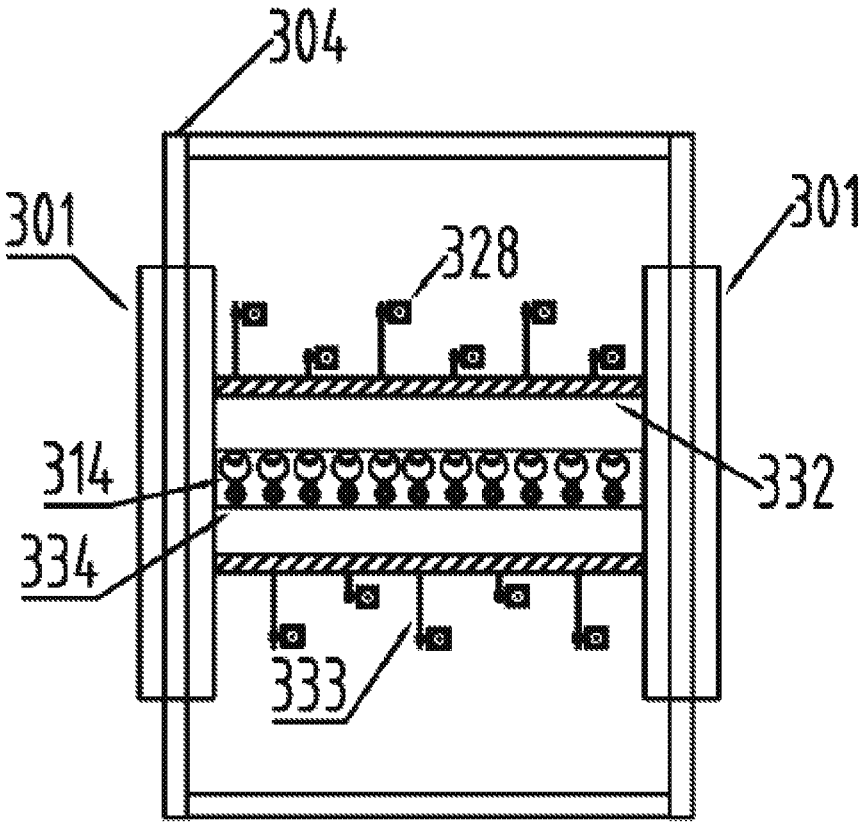
FIG. 9 is a top view of a rack and installation boxes.
Figure 10:
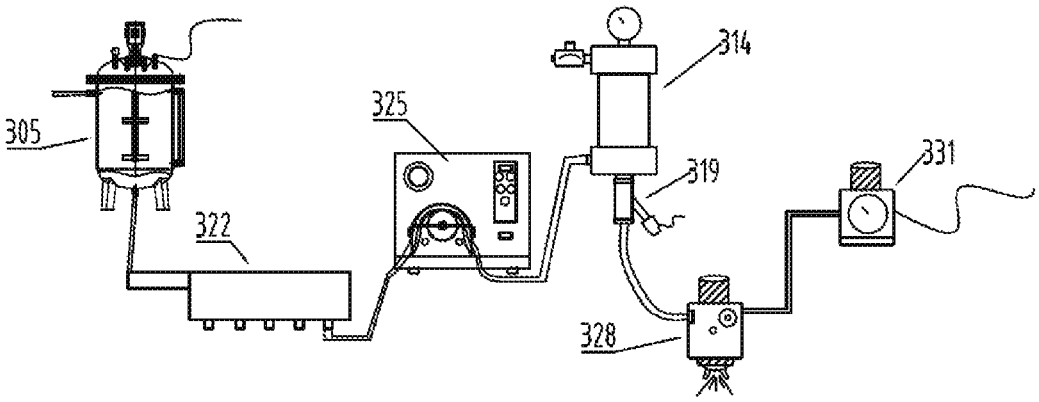
FIG. 10 schematically illustrates a single set of pulp sizing device.
Figure 11:
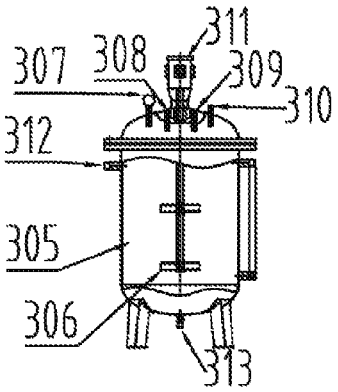
FIG. 11 schematically illustrates a constant pressure storage tank.
Figure 12:
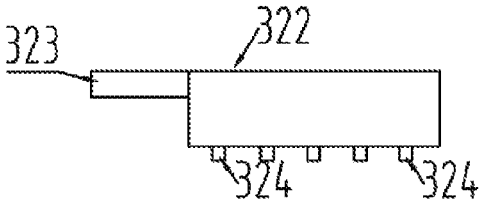
FIG. 12 schematically illustrates a pulp distributor.
Figure 13:
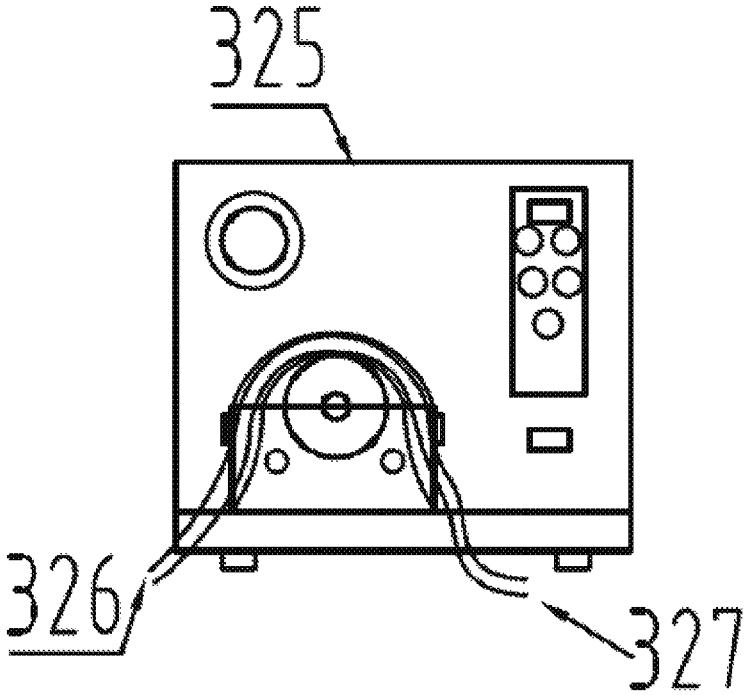
FIG. 13 schematically illustrates proportioning pump.
Figure 14:
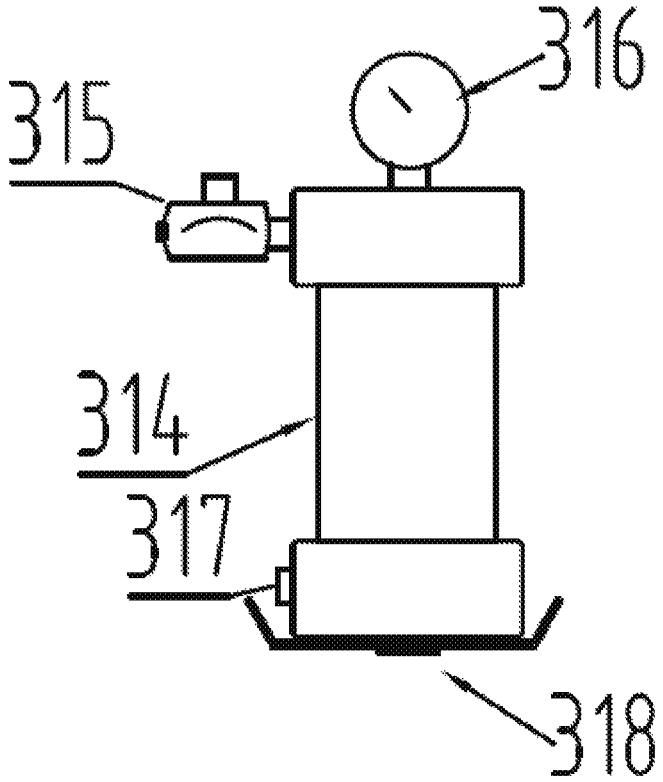
FIG. 14 schematically illustrates a pulp buffer.
Figure 15:
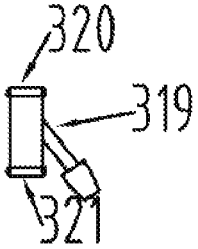
FIG. 15 schematically illustrates a check valve.
Figure 16:
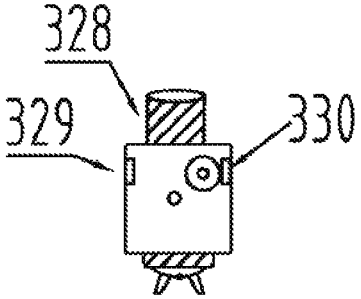
FIG. 16 schematically illustrates dual spray nozzle.
Figure 17:
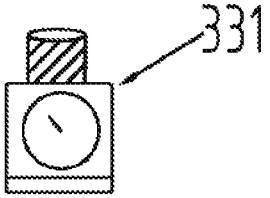
FIG. 17 schematically illustrates a compressed air regulating valve.
Figure 18:
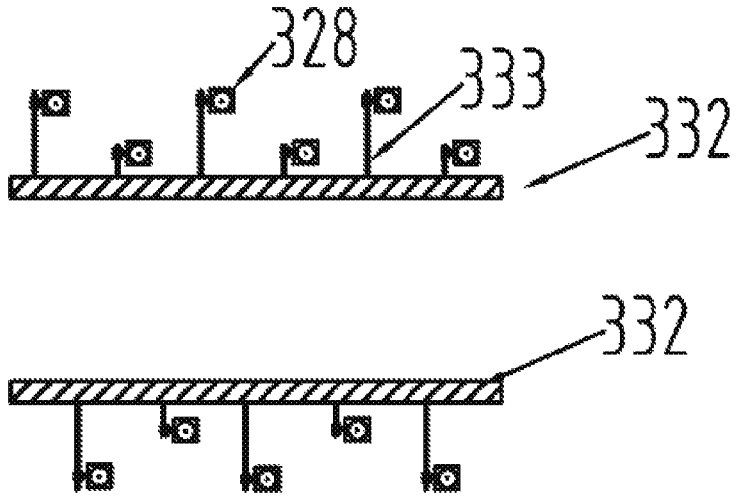
FIG. 18 schematically illustrates an arrangement of dual spray nozzles.
Figure 19:
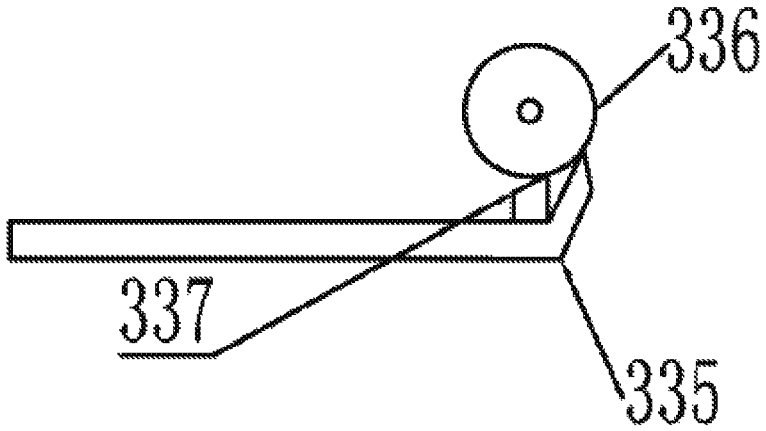
FIG. 19 is a front view of an adhesive receiving fence.
Figure 20:
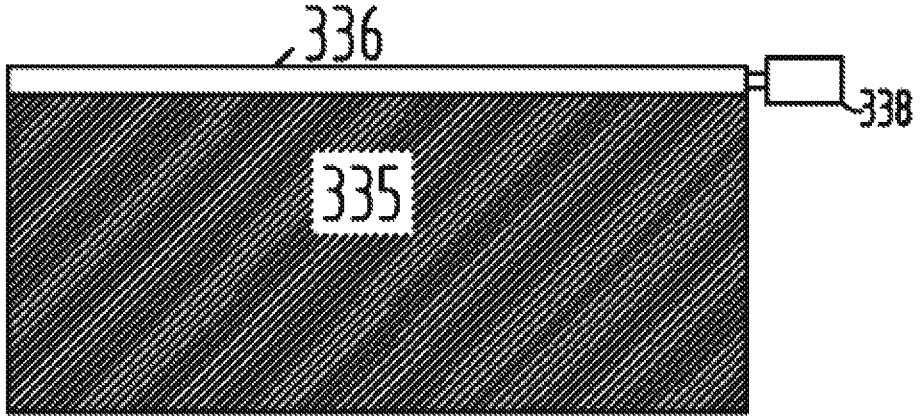
FIG. 20 is a top view of an adhesive receiving fence.
Figure 21:
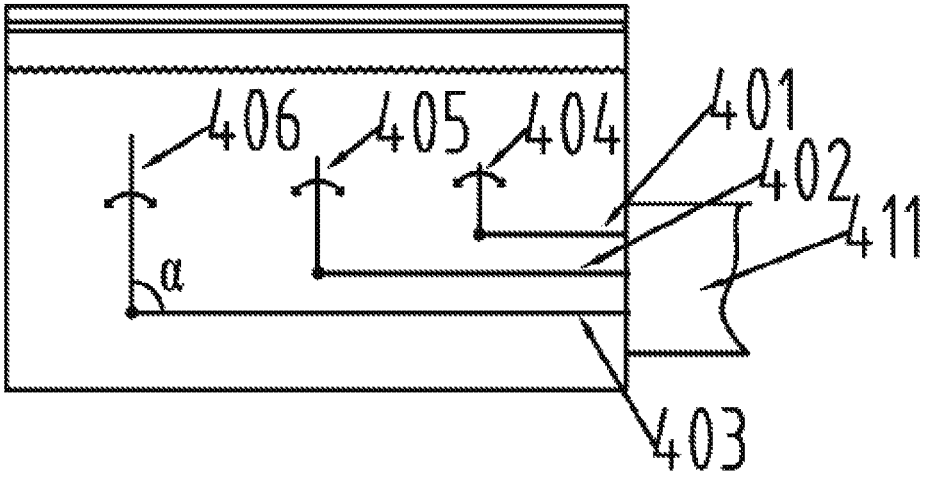
FIG. 21 is an internal structure of a drying oven.
Figure 22:
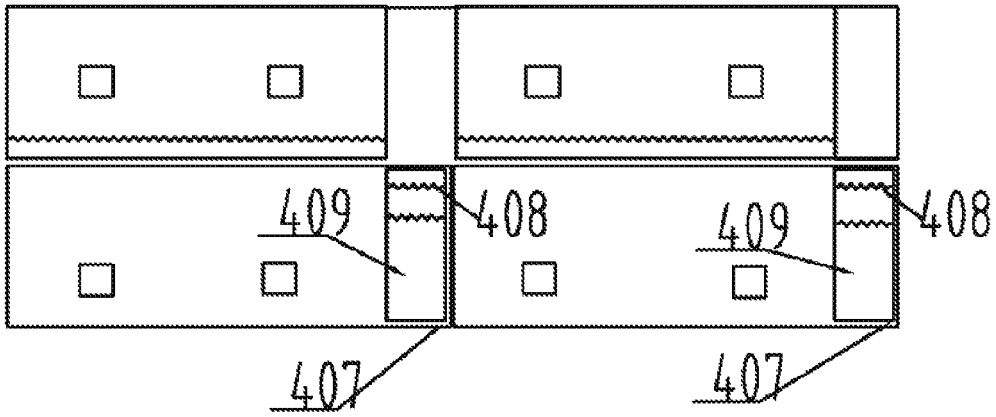
FIG. 22 schematically illustrates a drying oven
Figure 23:
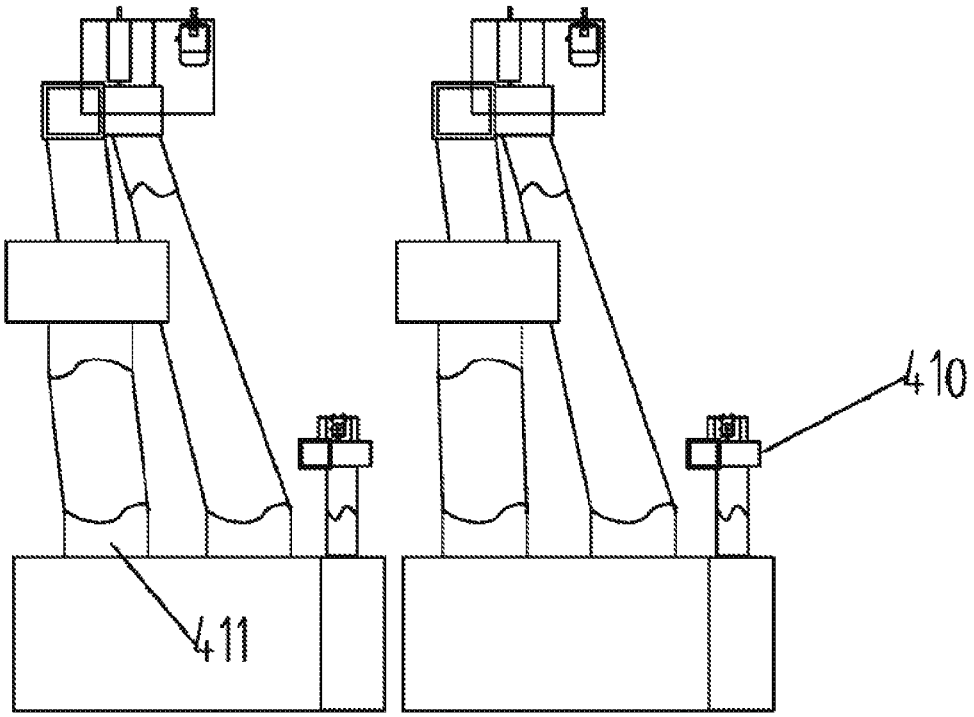
FIG. 23 is a top view of a drying oven.

FIGS. 1 and 2 illustrates a fiberizer, which comprises a rough crusher 101, a fine crusher 102, a fiber storage tank 103 and a fiber calculator 104 connected in series. A material inlet is arranged at a front end of the rough crusher 101, and a material outlet of the fiber calculator 104 is connected to the base-sheet forming device for producing reconstituted tobacco by using air-laid paper-making process. The fiberizer further comprises a high-moisture air generator 105 and high-moisture air pipelines, an output of the high-moisture air generator 105 is connected to the material inlet of the rough crusher 101 and the material outlet of the fiber calculator 104 via the high-moisture air pipelines respectively.

The rough crusher 101 further has an independent material inlet arranged at the front end thereof, the material inlet comprises a fiber material inlet 112 and a particulate material inlet 113, with independent switches arranged on the fiber material inlet 112 and the particulate material inlet (113) respectively. A movable and detachable multi-passage retainer is arranged at the material inlet.

By arranging two or more sets of material inlets on sides of the rough crusher, additionally introduced fiber-shaped or granule-shaped materials can be added to the rough crusher through these inlets. These extra added materials, together with the mixed plant fiber pulp boards coming from the material inlet, will be crushed into 1-2 $cm^2$ chips by rolling knives of the rough crusher. After being fiberized by fluted discs of the fine crusher, these chips, mixed with fiber-shaped or granule-shaped materials, will be put into a storage tank, whose agitators will mix these materials together. Finally, these mixed materials will be delivered to the fiber forming device by the fiber calculator. The above-inlets are controlled by a frequency converter, which establishes relevant modules for speed and quantity of the material inlet to make the formulation of different kinds of fibers in line with the one required by techniques in producing reconstituted tobacco base-sheets with the air laid process.

The high-moisture air generator has a capacity of 1 $m^3$ and provide sufficient atomizing moist air with a humidity of over 80% with the high-pressure nozzles or ultrasonic atomizer. A closed loop is formed by an $\phi$ 16 mm PE pipe arranged at the outlet of the high-moisture air generator and connecting a blower at the material inlet of the rough crusher and a blower at the fiber calculator 104. Under the influence of negative pressure of the fiberizing system, the wet air will constantly be sucked in to moisten an internal delivery system for plant fiber pulp boards.

Fiberized fiber will be sent into a base sheet forming device. As shown in FIGS. 3-7, the base-sheet forming device comprises forming mesh belts, a mesh belt conveying device, a base-sheet forming device rack 218 arranged above the forming mesh belts, one or more sets of forming heads are arranged inside the base-sheet forming device rack 218, a blow-off device is provided in the forming head, a negative pressure device is arranged underneath the forming mesh belts, a first screen cylinder 213 and a second screen cylinder 214 are arranged symmetrically to each other in each set of forming head, a first fiber conveying pipeline 201 and a second fiber conveying pipeline 202 are arranged along an axial direction of the first screen cylinder 213, a third fiber conveying pipeline 203 and a fourth fiber conveying pipeline 204 are arranged along an axial direction of the second screen cylinder 214, the first fiber conveying pipeline 201 and the second fiber conveying pipeline 202 are arranged symmetrically in an upper part of the first screen cylinder 213, the third fiber conveying pipeline 203 and the fourth fiber conveying pipeline 204 are arranged symmetrically in an upper part of the second screen cylinder 214, a first breaking roller 212 and a second breaking roller 211 are arranged in a lower part of the first screen cylinder 213 and a lower part of the second screen cylinder 214 respectively, the first breaking roller 212 and the second breaking roller 211 are located exactly under center points of the first screen cylinder 213 and the second screen cylinder 214 respectively, a front circular passage 215 and a rear circular passage 216 communicating internal spaces of the first screen cylinder 213 and the second screen cylinder 214 are arranged at front sides and rear sides thereof respectively.

The first fiber conveying pipeline 201 and the fourth fiber conveying pipeline 204 are of a same length, the second fiber conveying pipeline 202 and the third fiber conveying pipeline 203 are of a same length, and the first fiber conveying pipeline 201 is longer than the second fiber conveying pipeline 202.

The first fiber conveying pipeline 201 and the second fiber conveying pipeline 202 extend from a front part of the first screen cylinder 213 toward the interior of the first screen cylinder 213, and the third fiber conveying pipeline 203 and the fourth fiber conveying pipeline 204 extend from a rear part of the first screen cylinder 213 toward the interior of the first screen cylinder.

a. After going through the base-sheet forming device, the base sheets are sized by the pulp sizing device, and then dried by the drying device as shown in FIG. 8-23. The pulp sizing device comprises a constant pressurized storage tank 305 and a pulp distributor 322 connected to a material outlet of the constant pressurized storage tank 305, the pulp distributor 322 has multiple pulp outlets 324, each being connected to a pulp buffer 314 via a proportioning pump 325, the pulp buffer 314 is connected to a pulp inlet 329 of a dual spray nozzle 328 via a check valve 319, the dual spray nozzle 328 is further equipped with a compressed air inlet 330, a compressed air regulating valve 331 is connected to the compressed air inlet 330 through a pipeline. The pulp sizing device further comprises a sizing device rack 304 arranged on the mesh belt, installation boxes 301 are arranged on both sides of the sizing device rack 304, the pulp distributor 322 and the proportioning pump 325 are installed inside the installation boxes 301, the pulp buffer 314 is installed on a "⊔" shaped pulp buffer supporting rack 334 located in the middle of the sizing device rack 304. A nozzle supporting rack 332 is arranged in the middle of the sizing device rack 304, a plurality of nozzle supporting racks 333 with adjustable lengths and angles are arranged on the nozzle supporting rack 332, dual spray nozzles 328 are installed on the nozzle supporting racks 333.

The constant pressurized storage tank 305 comprises a tank body, a pulp outlet 313 arranged at a bottom of the tank body, a pulp inlet 312 arranged on a side at an upper part of the tank body and an agitator 306 arranged inside the tank body. The constant pressurized storage tank 305 is further equipped with a pressure indicator 307, an overpressure relief valve 308 arranged on an upper part of the tank body, a constant pressure controller 309 and a compressed air regulating valve 310. An agitator motor 311 connected to the agitator 306 is further arranged on the upper part of the tank body.

The pulp buffer 314 has a buffer pulp inlet 317 and a buffer pulp outlet 318. The pulp buffer inlet 317 is arranged on a side at a lower-middle part of the pulp buffer 314, the pulp buffer outlet 318 is arranged at a bottom of the pulp buffer 314, an exhaust valve 315 and a pressure indicator 316 are further arranged at an upper part of the pulp buffer.

The pulp distributor 322 has four pulp outlets 324 of. Through the pulp distributor, a constant pressurized storage tank may be connected to multiple sets of sizing devices to realize stable and synchronized sizing.

Two sets of nozzle supporting racks 332 are arranged symmetrically from each other in the installation box. Each nozzle supporting rack 332 has 8 nozzle supporting racks 333 arranged on an external side.

An adhesive receiving device 303 is arranged beneath the installation box 301. The adhesive receiving device 303 comprises an adhesive receiving tank and an adhesive receiving fence arranged on the adhesive receiving tank. An adhesive scraping device is arranged on the adhesive receiving fence and comprises a drive motor, an adhesive scraping roller connected to the drive motor, and an adhesive wiping board arranged on one end of the adhesive scraping roller.

The drying device comprises a drying device body and a hot-air inlet 411 connected to the drying device body, wherein three fixed dampers of a first damper 401, a second damper 402 and a third damper 403 are arranged in the drying device body, the three fixed dampers are arranged parallel to each other and distances between two neighboring dampers are equal to each other. The three fixed dampers are arranged in the drying device body and connected to the hot-air inlet 411. An adjustable baffle is arranged at a tail end of each damper, and a moisture-discharging device 407 is arranged at a rear end of the drying device body.

The adjustable dampers and fixed dampers are connected with movable pins. The angles between the adjustable baffle and the damper are adjustable.

Two sets of identical drying devices are connected via the forced moisture-discharging device. The forced moisture-discharging device 407 comprises a negative pressure box 409 and moisture deflectors 408 arranged inside the negative pressure box 409, the negative pressure box 409 is communicated to the body of the drying device, and connected to a negative-pressure blower 410 via a pipeline, and the negative-pressure blower 410 is connected to a controller of a frequency converter.

Forced moisture discharging device is arranged between every two sets of drying devices. The forced moisture discharging device comprises a deflector, a negative pressure box, which is connected to a negative pressure blower. The negative-pressure blower controlled by a frequency converter, forming a low temperature, fast drying system through drying, moisture discharging, second drying, and second moisture discharging.

With the above devices, on one hand, the fiberizer is equipped with different interfaces for various materials and an internal humidifying pipeline. As a result, multi-fiber and additives may be used at the same time, which helps to improve the taste of reconstituted tobacco leaves. The humidifying device helps to reduce static electricity generated in the process of fiberizing, effectively preventing the negative influence of antistatic agent on the taste of reconstituted tobacco leaves.

By utilizing multiple passages for material transfer and the unique design with breaking rollers, screen cylinders and annular devices, uniformity of incoming material and controllability are improved. Therefore, there will be no fiber accumulating inside the chamber, rendering a better uniformity for the formed base sheet. Since the fiber distributes evenly in the conveying pipelines with good controllability, basis weight of base sheet is less than 20 $g/m^2$ The sizing device of this invention can guarantee a higher solid content in the pulp to be evenly distributed and accurately measured. Therefore, pulp containing more tobacco dusts, tobacco extract, and adhesive agent may be sized, which has a strong adaptability.

In addition, the forced moisture discharging device is adopted to prevent tobacco components loss during the drying process, and to prevent significant temperature increase in the drying oven. Forced moisture elimination device is arranged between 2 sets of drying ovens to speed up air circulation to remove moisture in RTL. Drying device is installed with deflector to ensure whole sheets to dry synchronously, and to avoid tobacco aroma loss caused by partially high temperature and generating burnt taste.

Thus, the apparatus of the present invention can improve the overall productivity of reconstituted tobacco with obvious excellent effect.

The invention claimed is:

1. An apparatus that uses air-laid paper-making process to produce reconstituted tobacco, comprising a fiberizer, a base-sheet forming device, a pulp sizing device and a drying device connected in series, wherein the fiberizer comprises a rough crusher, a fine crusher, a fiber storage tank and a fiber calculator connected in series, a material inlet is arranged at a front end of the rough crusher, and a material outlet of the fiber calculator is connected to the base-sheet forming device of the apparatus, the fiberizer further comprises an anti-static humidifying device, the anti-static humidifying device comprises a high-moisture air generator and high-moisture air pipelines, an output terminal of the high-moisture air generator is connected to the material inlet of the rough crusher and the material outlet of the fiber calculator via the high-moisture air pipelines respectively;

the base-sheet forming device comprises forming mesh belts, a mesh belt conveying device, a base-sheet forming device rack arranged above the forming mesh belts, one or more sets of forming heads are arranged inside the base-sheet forming device rack, a blow-off device is provided in the forming head, a negative pressure device is arranged underneath the forming mesh belts, a first screen cylinder and a second screen cylinder are arranged symmetrically to each other in each set of forming heads, a first fiber conveying pipeline and a second fiber conveying pipeline—are arranged along an axial direction of the first screen cylinder, a third fiber conveying pipeline and a fourth fiber conveying pipeline are arranged along an axial direction of the second screen cylinder, the first fiber conveying pipeline and the second fiber conveying pipeline are arranged symmetrically in an upper part of the first screen cylinder, the third fiber conveying pipeline and the fourth fiber conveying pipeline are arranged symmetrically in an upper part of the second screen cylinder, a first breaking roller and a second breaking roller are arranged in a lower part of the first screen cylinder and a lower part of the second screen cylinder respectively, the first breaking roller and the second breaking roller are located exactly under center points of the first screen cylinder and the second screen cylinder respectively, a front circular passage and a rear circular passage communicating internal spaces of the first screen cylinder and the second screen cylinder are arranged at front sides and rear sides thereof respectively;

the pulp sizing device comprises a constant pressurized storage tank and a pulp distributor connected to a material outlet of the constant pressurized storage tank—, the pulp distributor has multiple pulp outlets, each being connected to a pulp buffer via a proportioning pump, the pulp buffer is connected to a pulp inlet of a dual spray nozzle via a check valve, the dual spray nozzle is further equipped with a compressed air inlet, a compressed air regulating valve is connected to the compressed air inlet through a pipeline, the pulp sizing device further comprises a sizing device rack arranged on the mesh belt, installation boxes are arranged on both sides of the sizing device rack, the pulp distributor and the proportioning pump are installed inside the installation boxes, the pulp buffer is installed on a pulp buffer supporting rack located in the middle of the sizing device rack, a main nozzle supporting rack is arranged in the middle of the sizing device rack, a plurality of nozzle supporting racks with adjustable lengths and angles are arranged on the main nozzle supporting rack, dual spray nozzles are installed on the nozzle supporting racks;

the drying device comprises a drying device body and a hot-air inlet connected to the drying device body; wherein three fixed dampers of a first damper, a second damper and a third damper are arranged in the drying device body, the three fixed dampers are arranged parallel to each other and distances between two neighboring dampers are equal to each other, the three fixed dampers are arranged in the drying device body and connected to the hot-air inlet, an adjustable baffle is arranged at a tail end of each damper, and a moisture-discharging device is arranged at a rear end of the drying device body.

2. The apparatus that uses air-laid paper-making process to produce reconstituted tobacco of claim 1, wherein the rough crusher of the fiberizer further has an independent material inlet arranged at the front end thereof, the material inlet comprises a fiber material inlet and a particulate material inlet, with independent switches arranged on the fiber material inlet and the particulate material inlet respectively.

3. The apparatus that uses air-laid paper-making process to produce reconstituted tobacco of claim 1, wherein a movable and detachable multi-passage retainer is arranged at the material inlet of the rough crusher of the fiberizer.

4. The apparatus that uses air-laid paper-making process to produce reconstituted tobacco of claim 1, wherein the first screen cylinder and the second screen cylinder of the base-sheet forming device are of opposite rotating directions.

5. The apparatus that uses air-laid paper-making process to produce reconstituted tobacco of claim 1, wherein each screen cylinder of the base-sheet forming device and a breaking roller arranged in the screen cylinder are of opposite rotating directions.

6. The apparatus that uses air-laid paper-making process to produce reconstituted tobacco of claim 1, wherein the first fiber conveying pipeline and the fourth fiber conveying pipeline of the base-sheet forming device are of a same length, the second fiber conveying pipeline and the third fiber conveying pipeline are of a same length, the first fiber conveying pipeline is longer than the second fiber conveying pipeline, the first fiber conveying pipeline and the second fiber conveying pipeline extend from a front part of the first screen cylinder toward the interior of the first screen cylinder, and the third fiber conveying pipeline and the fourth fiber conveying pipeline extend from a rear part of the first screen cylinder toward the interior of the first screen cylinder.

7. The apparatus that uses air-laid paper-making process to produce reconstituted tobacco of claim 1, wherein the pulp buffer supporting rack of the pulp sizing device is of a U shape.

8. The apparatus that uses air-laid paper-making process to produce reconstituted tobacco of claim 1, wherein the constant pressurized storage tank of the pulp sizing device comprises a tank body, a pulp outlet arranged at a bottom of the tank body, a pulp inlet arranged on a side at an upper part of the tank body and an agitator arranged inside the tank body, the constant pressurized storage tank is further equipped with a pressure indicator, an overpressure relief valve arranged on an upper part of the tank body, a constant pressure controller and a compressed air regulating valve, an agitator motor connected to the agitator is further arranged on the upper part of the tank body.

9. The apparatus that uses air-laid paper-making process to produce reconstituted tobacco of claim 1, wherein the pulp buffer of the pulp sizing device has a buffer pulp inlet and a buffer pulp outlet, the pulp buffer inlet is arranged on a side at a lower-middle part of the pulp buffer, the pulp buffer outlet is arranged at a bottom of the pulp buffer, an exhaust valve and a pressure indicator are further arranged at an upper part of the pulp buffer.

10. The apparatus that uses air-laid paper-making process to produce reconstituted tobacco of claim 1, wherein the adjustable baffles and the dampers of the drying device are connected through movable pins, and angles between the adjustable baffles and the dampers are adjustable.

11. The apparatus that uses air-laid paper-making process to produce reconstituted tobacco of claim 1, wherein the moisture-discharging device comprises a negative pressure box and moisture deflectors arranged inside the negative pressure box, the negative pressure box is communicated to the body of the drying device, and connected to a negative-pressure blower via a pipeline, and the negative-pressure blower is connected to a controller of a frequency converter.

12. The apparatus that uses air-laid paper-making process to produce reconstituted tobacco of claim 1, wherein lengths of the first damper, the second damper and the third damper of the drying device have equal differences between one and another, and partition the drying box into four sections.

* * * * *